US008187398B2

(12) United States Patent
Gash et al.

(10) Patent No.: US 8,187,398 B2
(45) Date of Patent: May 29, 2012

(54) ENERGETIC COMPOSITE AND SYSTEM WITH ENHANCED MECHANICAL SENSITIVITY TO INITIATION OF SELF-SUSTAINED REACTION

(75) Inventors: Alexander E. Gash, Brentwood, CA (US); Troy W. Barbee, Jr., Palo Alto, CA (US)

(73) Assignee: Lawrence Livermore National Security, LLC, Livermore, CA (US)

( * ) Notice: Subject to any disclaimer, the term of this patent is extended or adjusted under 35 U.S.C. 154(b) by 1201 days.

(21) Appl. No.: 11/804,454

(22) Filed: May 18, 2007

(65) Prior Publication Data

US 2010/0162913 A1 Jul. 1, 2010

Related U.S. Application Data

(60) Provisional application No. 60/802,077, filed on May 18, 2006.

(51) Int. Cl.

| | |
|---|---|
| ***C06B 45/00*** | (2006.01) |
| ***D03D 23/00*** | (2006.01) |
| ***D03D 43/00*** | (2006.01) |

(52) U.S. Cl. ..... 149/109.4; 149/2; 149/108.2

(58) Field of Classification Search ..... 149/109.4, 149/2, 108.2

See application file for complete search history.

(56) References Cited

U.S. PATENT DOCUMENTS

| | | | | |
|---|---|---|---|---|
| 5,538,795 | A * | 7/1996 | Barbee et al. | 428/420 |
| 5,547,715 | A * | 8/1996 | Barbee et al. | 427/561 |
| 6,863,992 | B2 * | 3/2005 | Weihs et al. | 428/607 |
| 6,875,522 | B2 * | 4/2005 | Seto et al. | 428/611 |
| 2004/0060625 | A1 * | 4/2004 | Barbee et al. | 149/15 |
| 2004/0234699 | A1 * | 11/2004 | Hale et al. | 427/421.1 |

OTHER PUBLICATIONS

US 6,875,521, 04/2005, Weihs et al. (withdrawn)

* cited by examiner

*Primary Examiner* — James McDonough
(74) *Attorney, Agent, or Firm* — James S. Tak

(57) ABSTRACT

An energetic composition and system using amassed energetic multilayer pieces which are formed from the division, such as for example by cutting, scoring, breaking, crushing, shearing, etc., of a mechanically activatable monolithic energetic multilayer(s) (e.g. macro-scale sheets of multilayer films), for enhancing the sensitivity of the energetic composite and system to mechanical initiation of self-sustained reaction. In particular, mechanical initiation of the energetic composition may be achieved with significantly lower mechanical energy inputs than that typically required for initiating the monolithic energetic multilayers from which it is derived.

12 Claims, 4 Drawing Sheets

ENERGETIC COMPOSITE AND SYSTEM WITH ENHANCED MECHANICAL SENSITIVITY TO INITIATION OF SELF-SUSTAINED REACTION

CROSS-REFERENCES TO RELATED APPLICATIONS

This application claims priority in Provisional Application No. 60/802,077, filed on May 18, 2006, entitled "Methods for Enhancing Mechanical Sensitivity of Energetic Multilayer Initiation" by Alexander E. Gash et al.

FEDERALLY SPONSORED RESEARCH OR DEVELOPMENT

The United States Government has rights in this invention pursuant to Contract No. W-7405-ENG-48 between the United States Department of Energy and the University of California for the operation of Lawrence Livermore National Laboratory.

BACKGROUND OF THE INVENTION

A. Technical Field

The present invention relates to energetic systems such as primers, igniters, and detonators, and more particularly to an energetic composite and system using an amassed plurality of energetic multilayer pieces which are formed from the division of a monolithic energetic multilayer, for enhancing the mechanical sensitivity of the energetic composite and system to initiation of self-sustained reaction.

B. Description of the Related Art

Many energetic systems such as primers, igniters, and detonators can be activated, i.e. ignited or detonated, via mechanical means, and as such are characterized as "impact initiated devices" or IID. Percussion primers used in small caliber (<20 mm) ammunition, and impact sensitive stab detonators used in medium caliber (20-60 mm) ammunition are two such examples.

Stab detonators in particular, such as illustrated at 10 in FIG. 1, are mechanically activated by stab initiation, a process by which a conical metal striker or firing pin 11 is mechanically driven (such as by a spring-loaded system) through a closure disc, cap, or seal 16 of an enclosure 12 and into at least a stab initiating mixture 13 (hereinafter "stab mix") contained in the enclosure and comprised of energetic powders which are sensitive to mechanical stimulus. The mechanical energy of the driven firing pin is converted into heat through compression and friction of the stab mixture, with the rapid heating resulting in ignition of the mixture. The stab mix is typically the first level (i.e. the primary ignition material) of a detonator train, which is often a three-stage system but can also be either a two stage system or a greater than three stage system. FIG. 1 in particular illustrates a representative three-stage detonator train contained in the enclosure 12, comprising: the stab mix 13, a transfer charge 14, and an output charge 15 which is the main high energy explosive. Arranged in this manner, the rapid decomposition of the stab mix during ignition generates a pressure/temperature pulse that is sufficient to initiate the transfer charge, which has enough output energy to detonate the main output charge. It is appreciated that both the transfer charge and the main output charge may be characterized as being activated by the stab mix, i.e. the primary ignition material. Such stab detonators are typically very small in size (e.g. M55 stab detonator dimensions: 0.3 cm diameter, 0.4 cm length) and are used in a number of energy release train systems where weight and size limitations preclude the use of other types of initiators (heat or electrical).

It is appreciated, however, that energetic ignition mixes known in the art and used in a large variety of IIDs (such as the stab mix in stab detonators) are typically lead-based materials. For example, one common type of ignition mix known as NOL-130 is composed of lead styphnate (basic) 40%, lead azide (dextrinated) 20%, barium nitrate 20%, antimony sulfide 15%, and tetrazene 5%. These materials can pose acute and chronic toxicity hazards during mixing of the composition and later in the item life cycle after the item has been field functioned. Thus there is an established need to replace these lead-based mixes on toxicity, health, and environmental hazard grounds.

Energetic multilayer structures and nanolaminates are also known in the art having as small as atomic level layer thicknesses, such as disclosed in U.S. Pat. Nos. 5,538,795 and 5,547,715 to Barbee, Jr. et al, both of which are incorporated by reference herein. Such energetic nanolaminates are often energetic foils of metal multilayers, also known as "flash metal." The exothermic reactions that are activated (such as by external mechanical input) in such energetic foils are the transformation of the multilayer material to its respective intermetallic alloy and the thermite reaction, which is characterized by very high temperatures, a small pressure pulse, and hot particle ejection. In particular, the energetic nanolaminates disclosed in the Barbee references are energetic multilayer flash metal foils capable of being prepared with tailored and precise reaction wave front velocities, energy release rates, and ignition temperatures. For example, the velocity of a multilayer thin film depends on the relative thickness and composition of each multilayer structure. Reaction front velocities from 0.2-100 meters/second can be prepared reliably and precisely. Multilayer reaction temperatures between 200 and 1500° C. are observed for multilayers with different compositional and structural characteristics. Heats of reaction from 0.1-1.8 kcal/g are capable with different multilayers. Various studies and reports are known which address the modeling and characterization of these properties and the influence of structure, composition, and processing conditions on such variables. Furthermore, the coating of sol-gels to multilayer energetic nanolaminates as energetic booster materials all also known, such as disclosed in U.S. Pat. Publication No. 2004/0060625 incorporated by reference herein, to further tailor reaction properties of nanolaminate igniters.

FIG. 2 illustrates a generic energetic nanolaminate construction, indicated at reference character 17, which is preferably a multilayer flash metal foil material that is periodic in one dimension in composition, or in composition and structure. They are fabricated by alternating deposition of two or more metallic materials. Individual layers can be varied in thickness from one atomic layer (~2 Å) to thousands of atoms thick (>10,000 Å). The total thickness of the multilayer foil is shown as 20 in FIG. 2. And the period of the multilayer foil is the distance (i.e. thickness) of the repeating sub unit structure comprising two adjacent metallic layers, hereinafter referred to as the "bi-layer" (such as 18 in FIG. 2) that makes up the foil. It is notable that also included in each bi-layer is a pre-reaction zone (such as 19 in FIG. 2) which is the interface region between the adjacent layers of the multilayer and is made up of a thin layer of intermetallic product formed during deposition.

Multilayer structured materials can be formed by various different techniques known in the art. Physical vapor deposition, chemical vapor deposition, electrochemical deposition, electrolytic deposition, atomic layer epitaxy, mechanical deformation processing, etc. are all utilized to prepare multilayer materials. One type of physical vapor deposition involves sputtering. In sputter deposition systems atoms, or clusters of atoms, are generated in the vapor phase by bombardment of a solid source material with energetic particles. The substrate is moved past the source(s) and vapor condenses on the substrate to form a film. A single layer of material is deposited on the substrate with each pass. The thickness of component layers, and thus it's resulting physical properties, is precisely controlled by adjusting the periodicity of substrate movement. And magnetron sputtering is one type of sputtering technique and is the physical vapor method of choice for the semiconductor industry. Using magnetron sputtering techniques, alternating layers of different elements, each several nanometers thick, can be deposited on top of one another to make nanometer metallic multilayers with a thin intermixed region between the layers.

FIG. 3 illustrates the use of such known energetic nanolaminates, such as 22, in stab detonators, such as 21, as a replacement for the stab mix discussed above as the primary ignition material. Arranged as such adjacent to the closure disc 16 the energetic nanolaminates are penetrated by firing pin 11 to initiate self-sustained reaction of the nanolaminate. However, to be a suitable replacement for the stab mix of stab detonators, the energetic nanolaminate must be sensitive enough to be initiated with an input energy typically in the range of 0.5-5 in./oz. (3.5 to 35 mJ). Based on experiments performed by the Applicants at the Lawrence Livermore National Laboratory, however, monolithic energetic nanolaminates have been shown to require energy inputs of at least twice the maximum acceptable level for ignition.

There is therefore a need for a replacement stab mix with enhanced mechanical sensitivity level for use as the primary ignition material to initiate self-sustained reaction in stab detonators, such as for example, M55 and M61 stab detonators.

BRIEF SUMMARY OF THE INVENTION

One aspect of the present invention includes an energetic composite capable of being mechanically activated, comprising: an amassment of a plurality of energetic pieces formed from the division of at least one monolithic energetic multilayer(s) and each having the multilayer structure of the monolithic energetic multilayer(s).

Another aspect of the present invention includes an energetic system capable of being mechanically activated, comprising: an enclosure having a first closed end and an opposite second closed end, said enclosure containing: a primary ignition material at the first closed end so as to be mechanically activatable therefrom and comprising an amassment of a plurality of energetic pieces formed from the division of at least one monolithic energetic multilayer(s) and each having the multilayer structure of the monolithic energetic multilayer(s); and at least one charge capable of being activated by the activation of the primary ignition material.

And another aspect of the present invention includes a method of fabricating an energetic composite capable of being mechanically activated, comprising: providing at least one monolithic energetic multilayer(s); and dividing the at least one monolithic energetic multilayer(s) into a plurality of energetic pieces each having the multilayer structure of the monolithic energetic multilayer(s), whereby the energetic pieces may be amassed in a confined volume for use as the energetic composite.

Generally, the present invention includes a mechanically activatable (i.e. ignitable or detonatable) energetic composite, an energetic system incorporating the use of such energetic composite as a primary ignition material, and a method of fabricating such energetic composites. The energetic composite comprises a plurality of energetic multilayer pieces which are formed by the actions of cutting, scoring, breaking, crushing, shearing, fragmenting, fractioning, or otherwise dividing one or more monolithic (e.g. a sheet) energetic multilayers or nanolaminates which is formed, acquired, or otherwise provided for use in reducing/transforming it into the energetic pieces. The energetic pieces formed in this manner are subsequently amassed in a confined area so as to be ignitable with a mechanical stimulus (e.g., a conical firing pin forced into the packed material). This action results in the initiation of a self-sustained reaction in the multilayer material that can reach temperatures of ~3000K and can be used to ignite other materials, such as but not limited to sheets of reactive multilayers, energetic powders, propellants, and explosives) used in devices that require prompt and reliable energy release. As such, the energetic composite of the present invention enables the use of this material in various applications, such as but not limited to, IIDs (e.g., stab detonators).

In an exemplary embodiment, a monolithic energetic multilayer coated with an energetic booster material, such as a sol-gel, is used for reduction by division into the energetic pieces of the energetic composite.

In another exemplary embodiment, capping layers may be applied to a monolithic energetic multilayer so as to, for example, control the level of sensitivity of the energetic pieces produced from it.

The energetic pieces of the present invention may be used alone amassed together as the energetic composite, or in combination with other objects or materials to further enhance or otherwise modify the mechanical sensitivity. In an exemplary embodiment, one or more monolithic energetic multilayers is contacted and combined with the amassment of energetic pieces such that the combination is characterized as the energetic composite, and which is usable as the primary ignition material of an energetic system, such as a stab detonator or other IID comprising a detonator train with a transfer charge and a main output charge.

BRIEF DESCRIPTION OF THE DRAWINGS

The accompanying drawings, which are incorporated into and form a part of the disclosure, are as follows.

DETAILED DESCRIPTION OF THE INVENTION

Figure 4:
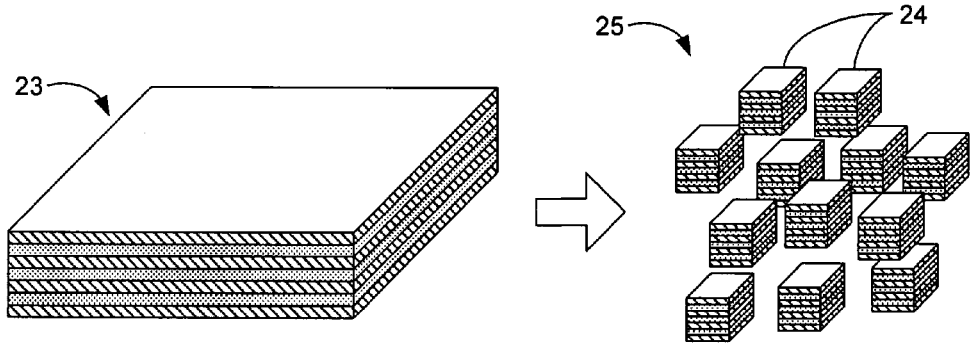
FIG. 4 is a first schematic representation of the reduction (by division) of an energetic multilayer nanolaminate to a plurality of energetic multilayer pieces.

Turning now to the drawings, FIG. 4 is a schematic representation showing the reduction of a monolithic energetic multilayer 23 into a plurality of energetic pieces 24, so that each energetic piece has substantially the same multilayer structure of the of monolithic energetic multilayer. The energetic pieces may then be amassed together as indicated at reference character 25 for use as the energetic composite of the present invention. Various types of monolithic energetic multilayers and nanolaminates known in the art may be formed, acquired ready made, or otherwise provided for reduction into the energetic pieces (see discussion below).

Various methods of dividing the monolithic energetic multilayer may be employed, such as but not limited to: cutting, scoring, breaking/fragmenting, crushing, shearing, or otherwise dividing. For example, macroscopic sheets of energetic nanolaminate material may be sheared (e.g. by hand using hand shears) to the desired size and scale of the individual pieces. Alternatively, as another example, a desired topography may be patterned into the substrate upon which the monolithic energetic nanolaminate is fabricated so as to fracture the monolithic nanolaminate along predetermined lines. By enabling the fracture along such fracture path sites the monolithic nanolaminate may be fracture in a controlled manner to form energetic multilayer pieces of the desired size with a well defined size distribution of the pieces. Various methods of patterning may be performed to effect such fracturing, such as by scribing the substrate, by depositing a ductile film on the substrate that can be subsequently scribed, by patterning the substrate using standard lithographic technology to enabling controlled nanolaminate fracture to form pieces of the desired size and scale having a tight size distribution. In this manner energetic pieces with uniform dimensions may be designed and fabricated, as well as improve the reduction to pieces by division process by eliminating the need for labor-intensive manual division methods, such as hand-shearing.

The plurality of energetic pieces produced can comprise pieces with different sizes. In particular, the energetic pieces are preferably divided to have sub-millimeter x and y dimensions, preferably from about 150 microns to about 450 microns in size. The energetic pieces have large x and y dimensions (i.e. the "size") relative to the thickness which is preferably from about 25 microns to about 100 microns total thickness, and is obtained from multilayer fabrication or selection. As used herein and in the claims, the "size" of an energetic multilayer piece is differentiated from the "thickness" of the energetic multilayer piece. The size is a function of the dividing step, and is considered the x and y planar dimensions of the multilayer. In contrast, the thickness is the total thickness of all the layers comprising the multilayer structure, and is thus a function of the multilayer fabrication process.

It is notable that while the energetic pieces of the present invention are suitably small in the sum-millimeter range, they are not a "powder" in the classic sense of dry fine particles or granules. It is also notable that as size distribution is a strong factor in the performance and behavior of energetic materials, various methods to control and classify the energetic pieces may be employed. For example, standard sieves may be used to sort and classify the energetic pieces on the basis of size dimensions. And while the mechanical sensitivity of the energetic composite is enhanced by the amassed energetic pieces, the reduction processing of monolithic energetic multilayers may nonetheless be safely performed. For example, punching and shearing of the monolithic multilayer with precision shim punches at room temperature has been shown to be very effective for safe handling, especially if the punches and shears are kept very clean.

Various types of the monolithic energetic multilayer or nanolaminate structure known in the art may be used to form the energetic pieces. For example, any of the energetic nanolaminates and fabrication methods disclosed in the Barbee references (U.S. Pat. Nos. 5,538,795 and 5,547,715, U.S. Pat. Publication No. 2004/0060625) discussed in the Background may be employed. In any case, it is appreciated that the stored energy and reaction velocities of the energetic multilayers and nanolaminates can be systematically and independently controlled by materials selection, size scale of the layers, etc. For example monolithic energetic multilayer having reduced thicknesses of individual layers is used to increase the reaction speed and sensitivity of the material. This is because with decreasing bi-layer thickness the average diffusion distance between reactant species in adjacent layers decreases. The bi-layer thicknesses of the foils can be readily and precisely controlled via magnetron sputtering. The bi-layer thickness of the multilayer structure of the monolithic multilayer and the energetic pieces is preferably from about 10 nm to about 200 nm.

The preferred material composition of the multilayer is preferably selected from, but not limited to, the following materials and their reaction products: aluminum, nickel, iron, aluminum oxide, titanium, zirconium, and iron oxide. In particular, the two materials of the bi-layers of the energetic multilayers are preferably selected from the group consisting of Zr/Al, Ni/Al, Al/Monel™400, Ni/Si, Mo/Si, Pd/Al, Rh/Al, Ti/B, Ti/C, Zr/B, Ti/$B_4C$, and Zr/$B_4C$.

It is appreciated that these materials have much more desirable environmental and health characteristics than the NOL-130 composition. The multilayers of the nanolaminate construction may be formed using zirconium and aluminum (Zr/Al), or nickel and aluminum (Ni/Al). Ideally, toxic and hazardous components (i.e. lead-based materials) are not utilized in the multilayer structure of the present invention, choosing instead a benign material.

It is appreciated that Nickel has health and environmental concerns of its own and its inclusion in new materials may become problematic. Therefore, although Ni or Ni-based alloy (Monel (Cu0.3Ni0.7)) may be utilized in the present invention for the energetic nanolaminates, a more benign material such as Zr/Al would be a better alternative for health and environmental safety.

The enthalpy of reaction of the alloying of zirconium and aluminum is 1.18 J/g and the adiabatic temperature is 1650° C. Although this Zr/Al system is less energetic than the Ni/Al system with an energy density of 1.38 J/g but has a slightly higher adiabatic reaction temperature than the Ni/Al system (1640° C.).

Thermodynamic data for selected formation reactions, which may be employed in the multilayer structure of the present invention, is shown in Table 1, and compiled from: I. Barin, O. Knacke, and O. Kubaschewski, eds., *Thermochemical Properties of Inorganic Substances, Supplement*, Springer-Verlag, New York, 1977; O. Knacke, O. Kubaschewski, and K. Hesselmann, eds., 2nd edition, *Thermochemical Properties of Inorganic Substances*, Springer-Verlag, New York, 1991; F. R. de Boer, R. Boom, W. C. M. Mattens, A. R. Miedema, and A. K. Niessen, *Cohesion in Metals*, North-Holland, N.Y. (1988), all of which are incorporated by reference herein.

TABLE 1

| Reaction | Heat of Reaction (kJ/mol Atoms) | Adiabatic Reaction Temperature (° C.) | Phase of Reaction Product |
|---|---|---|---|
| Ti + 2B -> $TiB_2$ | −108 | 2920 | solid & liquid |
| Zr + 2B -> $ZrB_2$ | −108 | 3000 | solid & liquid |
| Hf + 2B -> $HfB_2$ | −110 | 3370 | solid & liquid |
| V + 2B -> $VB_2$ | −68 | 2297 | Solid |
| Nb + 2B -> $NbB_2$ | −72 | 2282 | Solid |
| Ta + 2B -> $TaB_2$ | −63 | 2400 | Solid |
| Ti + C -> TiC | −93 | 3067 | solid & liquid |
| Zr + C -> ZrC | −104 | 3417 | solid & liquid |
| Hf + C -> HfC | −105 | 3830 | solid & liquid |
| V + C -> VC | −50 | 1957 | Solid |
| Nb + C -> NbC | −69 | 2698 | Solid |
| Ta + C -> TaC | −72 | 2831 | Solid |
| 5Ti + 3Si -> $Ti_5Si_3$ | −72 | 2120 | solid & liquid |
| 5Zr + 3Zi -> $Zr_5Si_3$ | −72 | 2250 | solid & liquid |
| 5Hf + 3Si -> $Hf_5Si_3$ | −70 | 2200 | solid & liquid |
| 5V + 3Si -> $V_5Si_3$ | −58 | 1519 | Solid |
| 5Nb + 3Si -> $Nb_5Si_3$ | −57 | 2060 | Solid |
| 5Ta + 3Si -> $Ta_5Si_3$ | −42 | 1547 | Solid |
| 2Ni + Si -> $Ni_2Si$ | −48 | 1306 | solid & liquid |
| Ti + Al -> TiAl | −36 | 1227 | Solid |
| Zr + Al -> ZrAl | −45 | 1480 | solid & liquid |
| Hf + Al -> HfAl | −46 | | |
| Ni + Al -> NiAl | −59 | 1639 | solid & liquid |
| Pd + Al -> PdAl | −92 | 2380 | Liquid |
| Pt + Al -> PtAl | −100 | 2800 | Liquid |

Figure 5:
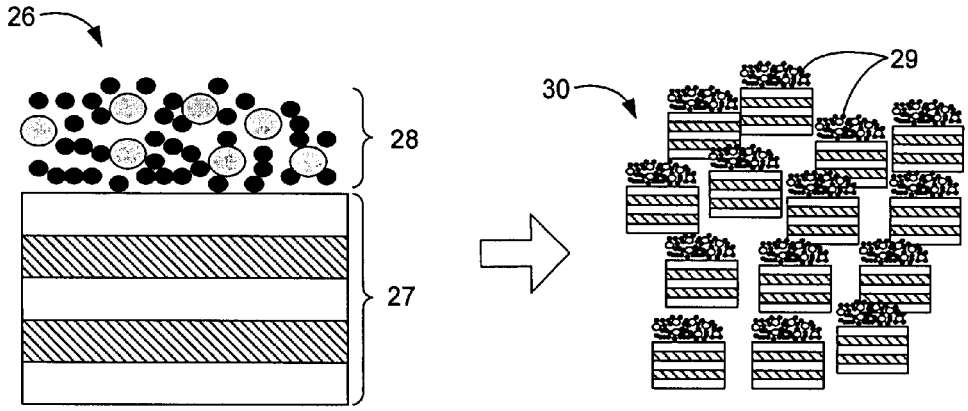
FIG. 5 is a second schematic representation of the reduction (by division) of an energetic multilayer nanolaminate to a plurality of energetic multilayer pieces, where the energetic multilayer is coated with an energetic booster material such as a sol-gel.

FIG. 5 shows a second schematic representation showing the reduction of a monolithic energetic multilayer 26 into a plurality of energetic pieces 29, (and amassed as 30) so that each energetic piece has substantially the same multilayer structure of the of monolithic energetic multilayer. As previously discussed, various types of monolithic energetic multilayers and nanolaminates known in the art may be formed, acquired ready made, or otherwise provided for reduction into the energetic pieces. Furthermore, as shown in FIG. 5, the energetic multilayer 27 is coated with an energetic booster material, such as sol-gel 28, as disclosed in U.S. Patent Publication No. 2004/0060625 to Barbee Jr. et al discussed in the Background, for the purpose of tailoring of mechanical sensitivity and energy output. Several mature methods known in the art, such as spin-, dip-, or spray coating may be used to coat the monolithic multilayer prior to the dividing step. In any case, FIG. 5 shows the division of the sol-gel coated nanolaminate 26, which when divided, produces a plurality of energetic pieces also coated with the sol-gel.

Figure 6:
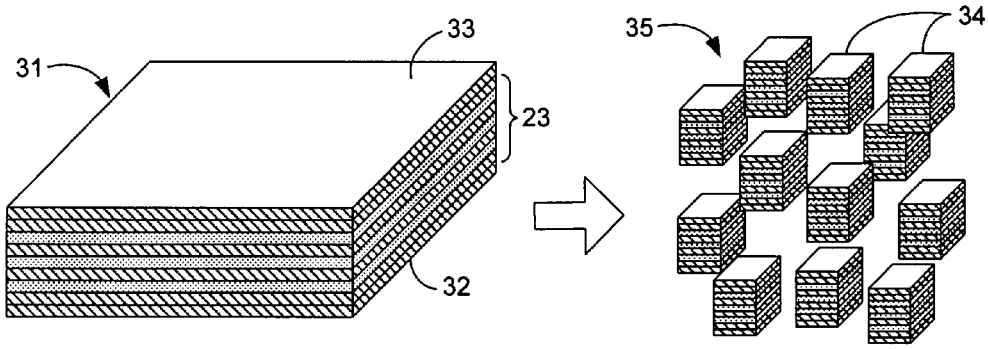
FIG. 6 is a third schematic representation of the reduction (by division) of an energetic multilayer nanolaminate to a plurality of energetic multilayer pieces, where the energetic multilayer is coated with a capping layer (shown on opposite sides of the multilayer.

FIG. 6 shows a third schematic representation showing the reduction of a monolithic energetic multilayer 31 into a plurality of energetic pieces 34 (and amassed as 35), so that each energetic piece has substantially the same multilayer structure of the of monolithic energetic multilayer. In FIG. 6, capping layers 32 and 33 are also coated on opposite sides of the monolithic energetic multilayer 23 based on a desired mechanical sensitivity of the amassed energetic pieces. It has been observed from experiments performed by Applicants at the Lawrence Livermore National Laboratory that energetic nanolaminates with thinner layers of reactant materials and no overcoats are much more sensitive to impact and friction than those with thicker layers, i.e. including capping layers of material. However, such capping layers 32 and 33. With no protective overcoat these materials will be more sensitive to mechanical stimulus, as no input energy will be required in the deformation and mixing of adjacent layers that have no heat of alloying (e.g. the mixing of adjacent capping layers). In addition, capping layers may also act as an inert substrate for the multilayer that acts as a heat sink that, under a given set of conditions, can act to quench the self-propagation of reacting foils.

Figure 1:
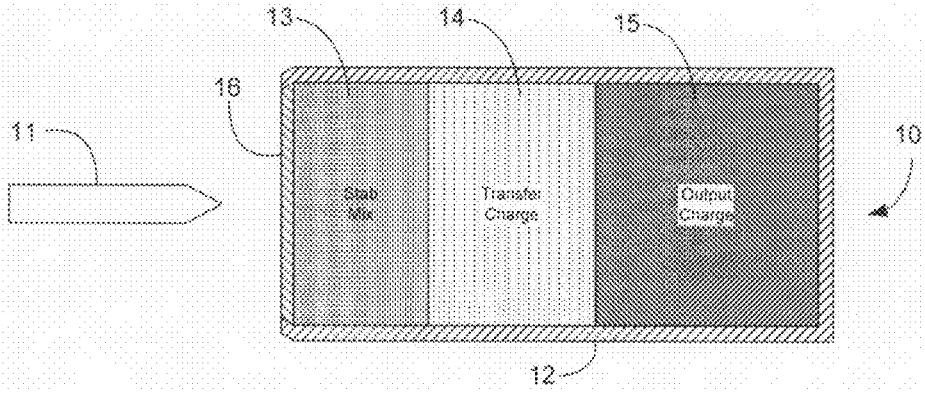
FIG. 1 (Prior Art)
FIG. 1 is a schematic cross-sectional view of a common stab detonator known in the art having a stab mix, such as NOL-130, as the primary ignition material.
Figure 2:
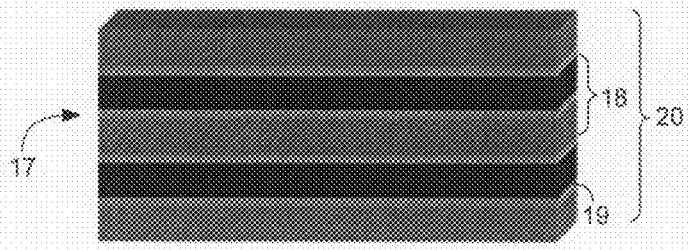
FIG. 2 (Prior Art)
FIG. 2 is a schematic view of an energetic nanolaminate known in the art, and illustrating the multilayer structure thereof.
Figure 7:
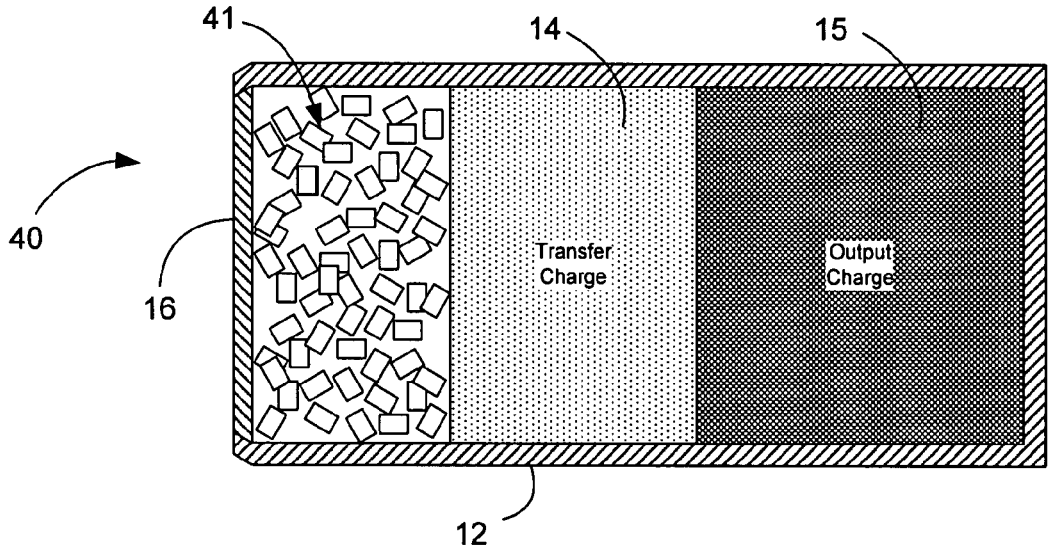
FIG. 7 is a cross-sectional view of a first exemplary embodiment of a three-stage energetic system (e.g. stab detonator) of the present invention, using amassed energetic pieces as the primary ignition material of a stab detonator.

FIG. 7 shows a first exemplary embodiment of an energetic system 40 of the present invention employing the energetic composite as the primary ignition material. Similar to the stab detonator 10 described in FIG. 1, the energetic system 40 is configured as a stab detonator and capable of being stab initiated by a conical metal striker or firing pin (not shown) drive through a closure disc, cap, or seal 16 of an enclosure 12 and into at least the energetic composite contained in the enclosure. In particular, FIG. 7 shows the energetic composite, i.e. primary igniter material, comprising only the amassment of energetic pieces 41 which is sensitive to mechanical stimulus. And similar to FIG. 1 the energetic system 40 is a three-stage detonator train contained in the enclosure 12, comprising: the amassment of energetic pieces 41, a transfer charge 14, and an output charge 15 which is the main high energy explosive.

Figure 3:
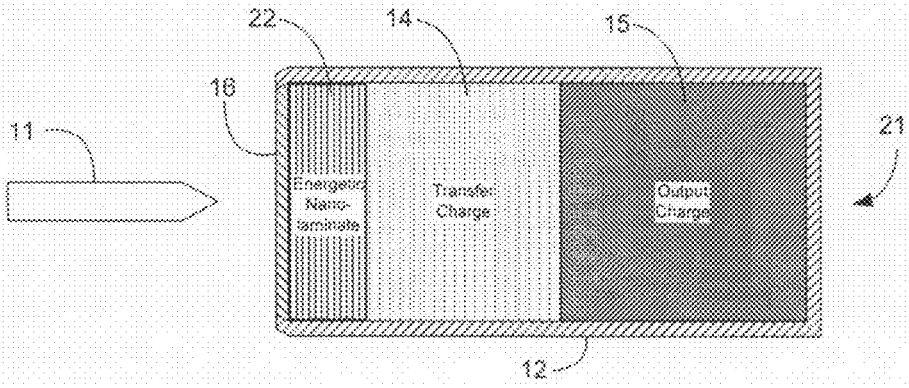
FIG. 3 (Prior Art)
FIG. 3 is a schematic cross-sectional view of a stab detonator known in the art using an energetic nanolaminate as the primary ignition material.

Experiments have shown that the use of amassed energetic pieces of the reactive monolithic multilayer materials leads to a significant increase in sensitivity of the material towards stab stimulus. This enables the use of such materials in impact initiated devices (stab detonators need to function with input energy of less than 5 in./oz.) where the total mechanical energy input is small and is limited by weight and size restrictions. The energetic pieces provide an abundance of interaction points, edges, and surfaces where friction occurs when struck by a hard fine point, like those used in mechanically activated energetic devices (stab firing pins). In contrast, energetic systems using a single or multiple monolithic energetic multilayers (as shown in FIG. 3) are pierced somewhere other than an edge by a firing pin there are far few of these surfaces and edges to interact and slide past one another.

Furthermore, the energetic composites (amassed pieces) which are division formed from multilayer foils with higher total thicknesses are more sensitive to mechanical impact. Although packed in a firing cup the energetic pieces must be considered to be in a partially confined geometry. There are gaps and voids in the amassment that allow movement of the multilayer pieces past one another, which will lead to significant inter-piece friction. The thicker foils are stronger materials, thus they do not fracture as easily as a thinner material does. Thus, in this partially confined geometry more of the mechanical energy may be translated into frictional heating rather than into fracturing of the multilayer structure of the energetic pieces and it is that frictional heating that initiates the self-propagating reaction.

Figure 8:
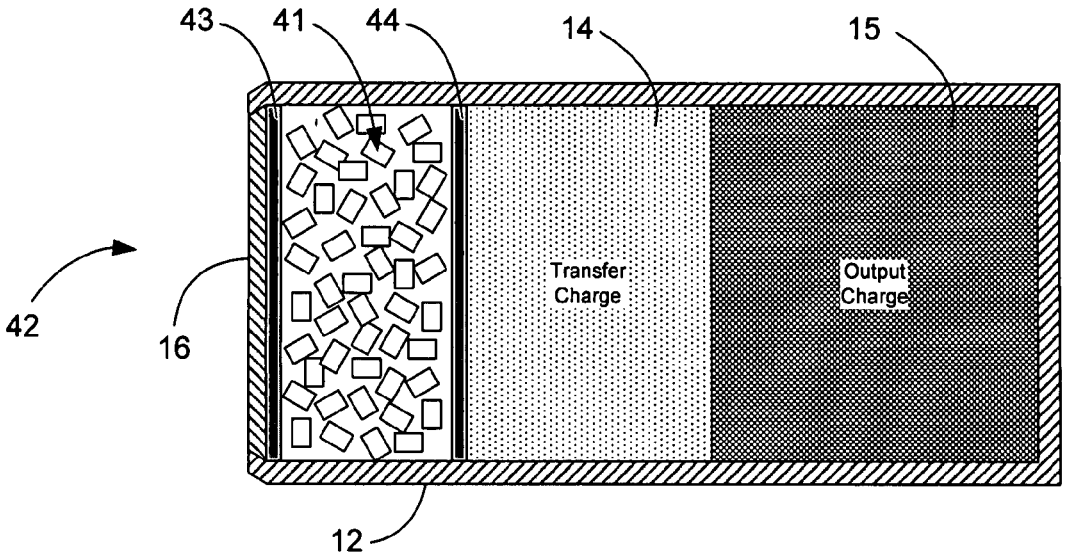
FIG. 8 is a cross-sectional view of a second exemplary embodiment of a three-stage energetic system (e.g. stab detonator) of the present invention, using an energetic composite comprising an amassment of energetic pieces and two monolithic energetic nanolaminates on opposite sides of the amassment.

FIG. 8 shows a second exemplary embodiment of an energetic system of. the present invention employing the energetic composite as the primary ignition material. In particular, two monolithic energetic multilayers 43 and 44 (shown as disks)

are shown placed in contact with the amassment of energetic pieces 41 on opposite sides thereof. In particular, monolith 43 (i.e. the first disk, in order of initiation) is adjacent the closure end 16 so that it is impacted first, and monolith 44 (i.e. the second disk) is between the amassment 41. The purpose of the initial disk 43 is to provide a surface that when impacted first by the striker pin will impart a significant force across the area of the amassment. The uncoated energetic pieces of the amassment have inter-piece void spaces that provide space for numerous pieces to slide past one another where they have many opportunities to heat up of fracture or some combination of the two to ignite. Once ignited in a small portion the entire amassment ignites. The second disk 44 is then ignited and provides a large rapidly heated continuous hot surface to ensure heat shock initiation of the transfer charge (lead azide detonates above 370° C.). As illustrated by FIG. 8, enhanced mechanical sensitivity is observed for energetic composites of the present invention having different configurations, and thus some variability in the design or configuration of the amassed energetic pieces of the energetic composite is possible within the stab detonator. In particular, use of the amassed energetic pieces either by itself or in some geometric contact with monolithic energetic multilayers is sufficient for improved mechanical sensitivity.

Although not shown in the figures, a process which illustrates the fabricating of the energetic system of FIG. 8 can involve placing a first monolithic disk, e.g. with a diameter of 3.17 mm in the bottom of an M55 cup. The mass of one disk of this type is nominally ~2-3 mg. On top of that first disk, 6-8 mg of energetic pieces are poured into the confined space to amass the pieces together, and finally a second disk is placed on top of the amassment. This configuration is then tamped down in the cup, before a transfer charge 14 is pressed on top of it for live detonators (surrogate powder is pressed here in the case of mock detonators). It is notable that the striker pin of the stab detonator pierces the closure end 16 of the M55 cup 12 and therefore interacts with the first disk 43 first. The total mass of the combined amassment and two monolithic disks is ~12-16 mg. This is only slightly less than the 18 mg of NOL-130 currently used in M55 munitions, however the bulk density of the energetic foils (5.1 g/cm3 for Ni/Al) is significantly higher than the bulk density of the NOL-130 mix (~3.3 g/cm3).

Figure 9:
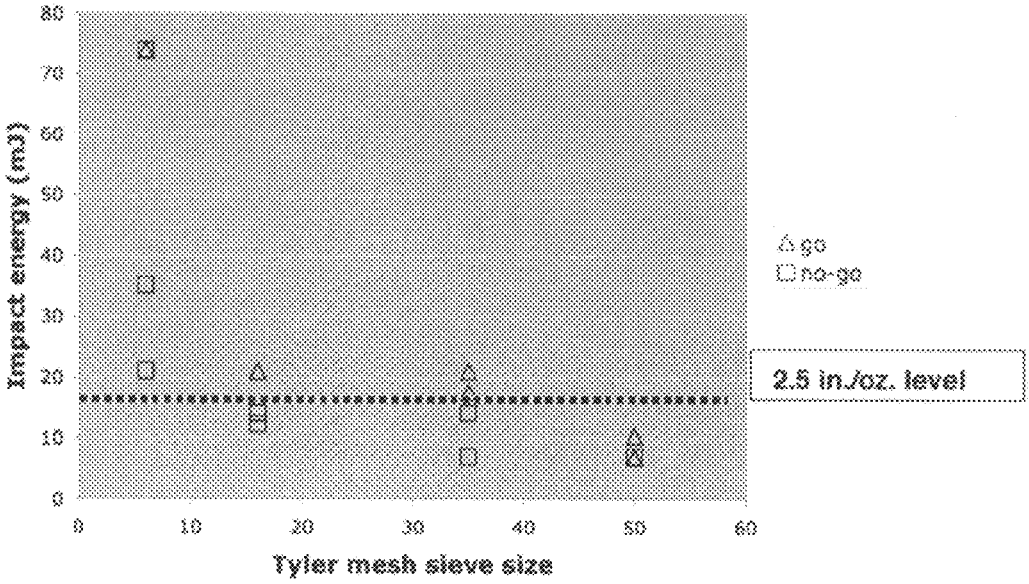
FIG. 9 is a graph of W. S. Tyler standard sieve size for energetic multilayer pieces vs. impact energy for uncoated Al/Monel multilayers used in mock stab detonators. The configuration for these mock detonators was disk/amassment of pieces/disk like that shown in FIG. 8.

As shown in FIG. 9, mechanical sensitivity is also a function of the size dimensionality of the energetic pieces. This is shown in FIG. 9 where the impact energy is plotted vs. the W. S. Standard Tyler Sieve size for the energetic pieces. As shown, the Standard Sieve size number increases as the size of the energetic pieces decreases.

The present invention may be used for initiation of energetic nanolaminates that can perform useful functions such as for example: heating, for example for vaporizing a drug (such as for example disclosed in U.S. Pat. Pubs. 20040234699, 20040234914, and 20040234916), or joining solid metals or propulsion, such as described by Weihs et al. (U.S. Pat. Nos. 6,863,992, 6,875,521, 6,736,942). Additionally, applications disclosed in U.S. Pat. Nos. 5,547,715, and 5,538,795 may also be performed, such as (i) igniters, (ii) joining, (iii) new materials, (iv) smart materials and (v) medical devices and treatments. Commercial or other uses or possibilities for use include: igniters for energy release systems that could span any number of areas (e.g., air bags, biomedical devices, energy sources for lab-on-a-chip (MEMS micro-electromechanical systems)).

While particular operational sequences, materials, temperatures, parameters, and particular embodiments have been described and or illustrated, such are not intended to be limiting. Modifications and changes may become apparent to those skilled in the art, and it is intended that the invention be limited only by the scope of the appended claims.

We claim:

1. An energetic composite capable of being mechanically activated, comprising:

an amassment of a plurality of energetic multilayer pieces contacting each other at a plurality of interaction points, edges, and surfaces, with each energetic multilayer piece having the same multilayer structure as a monolithic energetic multilayer sheet but with a lesser surface area than the monolithic energetic multilayer sheet.

2. The energetic composite of claim 1, wherein the energetic multilayer pieces are energetic nanolaminates.

3. The energetic composite of claim 1, further comprising at least one monolithic energetic multilayer sheet(s) having a sheet surface in contact with the amassment of energetic multilayer pieces.

4. The energetic composite of claim 3, wherein respective sheet surfaces of first and second monolithic energetic multilayers are in contact with the amassment of energetic multilayer pieces on opposite sides of the amassment.

5. The energetic composite of claim 1, wherein the energetic multilayer pieces include an overcoat layer comprising an energetic booster material.

6. The energetic composite of claim 5, wherein the energetic booster material is a sol-gel.

7. The energetic composite of claim 1, wherein the energetic multilayer pieces are formed to be from about 150 microns to about 450 microns in size based on a desired mechanical sensitivity of the energetic composite.

8. The energetic composite of claim 1, wherein the multilayer structures of the energetic multilayer pieces have a total thickness from about 25 microns to about 100 microns based on a desired mechanical sensitivity of the energetic composite.

9. The energetic composite of claim 1, wherein the multilayer structures of the energetic multilayer pieces are comprised of two materials of a type reactive with each other, in alternating layered arrangement to form a set of repeating bi-layers.

10. The energetic composite of claim 9, wherein the thickness of the bi-layers is from about 10 nm to about 200 nm based on a desired mechanical sensitivity of the energetic composite.

11. The energetic composite of claim 9, wherein the multilayer structures of the energetic multilayer pieces include a capping layer based on a desired mechanical sensitivity of the energetic composite.

12. The energetic composite of claim 9, wherein the two materials of the bi-layers are selected from the group consisting of Zr/Al, Ni/Al, Al/Monel™ 400, Ni/Si, Mo/Si, Pd/Al, Rh/Al, Ti/B, Ti/C, Zr/B, Ti/$B_4C$, and Zr/$B_4C$.

* * * * *